United States Patent [19]

Feustel et al.

[11] Patent Number: 4,840,202

[45] Date of Patent: Jun. 20, 1989

[54] ELECTRICALLY CONDUCTIVE TWO COMPONENT TWISTED YARN AND FABRICS FOR TEXTILE FLAT GOODS FOR CLEAN ROOMS AND CLEAN ROOM WEARING APPAREL

[75] Inventors: Mattias Feustel, Triebes; Guenter Frotscher, Greiz-Gommla; Wieland Nitschke, Greiz; Dieter Obenauf, Greiz; Juergen Saupe, Dresden; Manfred Weidelt, Gera-Lusan, all of German Democratic Rep.

[73] Assignee: VEB Forschung und Entwicklung, Greiz, German Democratic Rep.

[21] Appl. No.: 115,679

[22] Filed: Oct. 30, 1987

Related U.S. Application Data

[62] Division of Ser. No. 926,596, Nov. 3, 1986.

[30] Foreign Application Priority Data

| | | | |
|---|---|---|---|
| Nov. 8, 1985 | [DD] | German Democratic Rep. | 2826362 |
| Jun. 2, 1986 | [DD] | German Democratic Rep. | 2907933 |
| Jun. 9, 1986 | [DD] | German Democratic Rep. | 2911013 |

[51] Int. Cl.[4] ..... D03D 15/02

[52] U.S. Cl. ..... 139/425 R

[58] Field of Search ..... 139/425 R, 425 A, 408, 139/413; 57/212, 222, 231, 232, 238, 243, 252, 901

[56] References Cited

U.S. PATENT DOCUMENTS

| | | | |
|---|---|---|---|
| 3,422,460 | 1/1969 | Burke et al. | 139/425 R |
| 3,851,456 | 12/1974 | Hamada et al. | 57/238 |
| 4,138,519 | 2/1979 | Mitchell | 139/425 R |
| 4,313,998 | 2/1982 | Pivot et al. | 57/212 |
| 4,431,316 | 2/1984 | Massey | 139/425 R |
| 4,647,495 | 3/1987 | Kanayama et al. | 57/901 |

*Primary Examiner*—Henry S. Jaudon

*Attorney, Agent, or Firm*—Jordan and Hamburg

[57] ABSTRACT

A fabric according to the invention is made by weaving electrically nonconductive lower ply warp yarns together with electrically nonconductive lower ply filling yarns in a 1/1 plain weave. Within a pattern repeat, 4 electrically nonconductive upper ply filling yarns are additionally interwoven in a plain weave fashion with 4 electrically nonconductive upper ply filling yarns. Two electrically conductive combination yarns, as warp yarns within a pattern repeat, are interwoven with all electrically nonconductive upper ply filling yarns within the pattern repeat into a 2/2 twill weave opposite to the twill woven upper ply warp yarns. The nonconductive filling yarns of the lower ply thus provide an additional supporting effect for the electrically conductive combination yarns. By these means, the electrically conductive combination yarns are stressed substantially less by bending, thus not breaking, whereby the electrical conductivity is thus retained and the functional life is prolonged. The fabrics find use as clean room textile flat goods and in wearing apparel for clean rooms.

2 Claims, 2 Drawing Sheets

ELECTRICALLY CONDUCTIVE TWO COMPONENT TWISTED YARN AND FABRICS FOR TEXTILE FLAT GOODS FOR CLEAN ROOMS AND CLEAN ROOM WEARING APPAREL

This is a division of application Ser. No. 926,596 filed Nov. 3, 1986.

The invention relates to an electrically conductive twisted yarn or thread comprising the combination of a metal wire and an electrically nonconducting synthetic filament component and which, when suitably woven and finished, is suitable for fitting out "clean rooms", as well as for clean-room wearing apparel, a method for producing such a yarn, and woven fabric comprised of the aforementioned yarn.

BACKGROUND OF THE INVENTION

It is well known that fabrics and garments for "clean rooms" in the areas of microelectronics, medicine, pharmaceuticals, industrial ceramics and the film and sound recording industry are predominantly made of polyester filaments, which admittedly have an adequately low particle emission, but do not guarantee protection of the components, for example, sensitive microcircuits, sensitive integrated circuits and other sensitive semiconductors, against static electricity.

To reduce or eliminate the aforementioned defect, it is furthermore known that antistatic chemicals may be applied in the form of additives in detergents and rinsing aids or in the form of sprays on the wearing apparel. Admittedly, these chemicals reduce the cling effect of the wearing apparel to the body of the wearer, but they do not prevent the build-up of a high static charge on the surface of the wearing apparel. Moreover, such chemicals are not washfast.

Aside from a thin, narrow metal foil as a central layer, known metal laminated threads have a covering layer comprising a thin plastic film. For this reason, these threads are not suitable for the purpose mentioned, since only the thin edges of the middle metal layer are exposed, with which the static electricity cannot be dissipated adequately.

Admittedly, charges of static electricity are dissipated and dispersed by the use of metal fibers and metal threads in yarns. However, the fabrics manufactured therefrom have a negative effect on the particle emission, due to the hairiness of the yarns, and are therefore not suitable for "clean rooms".

Moreover, untextured monofilaments have been used, which achieve electrical conductivity owing to the fact that they have a plurality of electrically conductive particles, which are applied on or embedded in the surface of the monofilaments and thus impart electrical conductivity. These electrically conductive monofilaments are twisted together with at least one synthetic filament, which is neither textured nor electrically conductive. The fabric produced from these filaments and the wearing apparel produced therefrom admittedly are suitable for "clean rooms", since the particle emission is low an the electrical conductivity is good. However, they are susceptible to failure resulting from a mutual shift of the individual components when subjected to the action of mechanical forces. As a result, malfunctions of the conductivity of the fabric may arise due to damage to the conductive component.

SUMMARY OF THE INVENTION

It is an object of the invention to avoid these disadvantages and to provide an electrically conductive combination twisted yarn, which has a minimal particle emission as well as a minimal particle permeability, dissipates or disperses static electricity and has optimum cleaning and care properties, as well as good wearing properties.

A further object of the invention is to develop a fabric which, aside from safeguarding the property of electrical conductivity, significantly increases the loop strength and crack resistance of the wire in the combination thread, decisively decreases the particle permeability and improves the wear comfort.

To achieve these objects, the present invention provides, using a metal component, an electrically conductive two component (hereinafter "combination") twisted yarn, which is suitable as a basis for textile flat goods and has the requisite conductivity, the textile character being retained.

Further according to the present invention, an electrically conductive combination twisted yarn, which uses a metal component, is provided by means of a wrapping process operating according to the hollow spindle principle process, the yarn being suitable as a basis for textile flat goods and having the requisite conductivity, the textile character being retained.

Additionally, the present invention provides a fabric construction, in which electrically conductive combination threads are interlaced so that the loop strength and crack resistance of the fine wire in the combination thread are increased substantially.

BRIEF DESCRIPTION OF THE DRAWINGS

The invention will be better understood by reference to the accompanying drawings, in which.

DETAILED DESCRIPTION OF THE PREFERRED EMBODIMENTS

Figure 1:
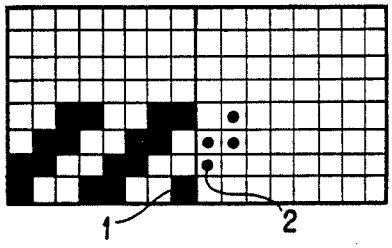
FIG. 1 is a schematic plan view of the weave of an upper ply of a fabric incorporating electrically conductive combination threads according to the invention.

The electrically conductive combination twisted yarn of the present invention comprises a metal wire component and a preferably jet-textured synthetic filament component, the electrically conductive component, conducted to the synthetic filament component with an at least 20% lower tension/thread tensile force than is applied to the synthetic filament component, lying electrically conducting in a helical line on the surface of the twisted yarn. This combination twisted yarn represents a combination of a synthetic filament yarn with a metal wire, produced with a yarn tension level of preferably 8% of the denier-related breaking strength of the synthetic filament yarn. The metal component comprises a conventional commercial chromium-nickel-molybdenum alloy which, however, is not in use in the spinning sector.

In a related aspect of the present invention, a polyester filament yarn, having an extremely low elasticity and produced according to the jet process, is used as a core component with a metal wire being wrapped around the core component, the tension being applied to the core component yarn by means of known infinitely variable yarn brakes amounting at most to 12% of the breaking strength of the core component yarn. The sheath component comprises a metal wire of a known chromium-nickel-molybdenum alloy which, with an approximately parallel winding, is on a rotatable creel spool and, by means of a downtwister, is wrapped around the core component in heilcal form, at a spindle speed of 10,500 r.p.m., at the rate of 350 turns/minute.

This combination twisted yarn is used in a fabric repeatedly in the wrap and filling directions, it being characteristic that, aside from this combination twisted yarn, a plurality of untextured and/or textured nonconductive synthetic filaments are used in both directions of the fabric.

The weave of the fabric is preferably designed so that the conductive combination twisted yarn is woven repeatedly in the warp and filling directions, so that the conductive component of the combination double yarn is situated repeatedly at the surface, so as to achieve good conductivity for the dissipation of static electricity.

Furthermore, this fabric must have a plurality of thread crossings, in order to ensure minimal particle emission and particle permeability. Aside from these properties, an appropriate wear comfort is assured by the use of textured threads. This fabric is dyed and/or finished by known technologies without significant additional expenditures. When manufacturing garments from the fabrics so woven and finished, it is necessary that the manufactured parts be so assembled, that as many conductive combination twisted yarns as possible are in contact.

Textile flat goods in which electrically conductive combination threads are incorporated can consist of a flat fabric with a 2/1 twill weave in which the diagonal lines appearing on the surface of the weave run in the "Z" direction. For this construction, the electrically conductive combination yarn is interlaced "rigidly" due to frequent yarn crossings, which stress the electrically conductive combination thread in bending at very short intervals. With this, the usefulness, for example the lasting effectiveness of the conductivity, can be curtailed. The danger exists that the fine wire in the combination yarn will break, for example, as a result of the mechanical stress when the fabric is being worn on the body. Such breakages would lead to local interruptions of continuous electrical conductivity. The fine wire, due to such a breakage, will become detached from the structural formation and bring about unsatisfactory wear comfort. Breakage occurs because of the low loop strength and crack resistance as well as the low elasticity of the fine wire.

Therefore, in accordance with the present invention, an electrically conductive combination yarn is interlaced flexibly in a multi-ply fabric, preferably a two-ply fabric, the electrically conductive combination yarns in the upper ply being woven in loosely and the lower ply stabilizing the unstable elastic upper ply. The lower ply is interwoven with the electrically nonconductive yarns of the upper ply. The electrically nonconductive warp yarns of the lower ply are disposed in the immediate vicinity of the electrically conductive combination yarns, which lie in the warp direction. More particularly, the electrically nonconductive lower ply warp threads are interwoven with the electrically nonconductive lower ply filling (weft) yarns in a 1/1 plain weave. Additionally, within a pattern repeat, 4 electrically nonconductive lower ply warp yarns are interwoven with 4 electrically nonconductive upper ply filling yarns in twill weave fashion. Moreover, 2 electrically conductive lower ply combination yarns, as warp yarns within a pattern repeat, are interwoven with all electrically nonconductive upper ply filling threads in the pattern repeat in a 2/2 "Z" direction twill weave opposite to the 2/2 "Z" direction twill woven upper ply warp threads. The nonconductive filling threads of the lower ply thus have an additional supporting effect for the electrically conductive combination threads. By these means, the electrically conductive combination threads are stressed substantially less by bending, the electrical conductivity is retained and the functional lifetime is prolonged.

Figure 2:
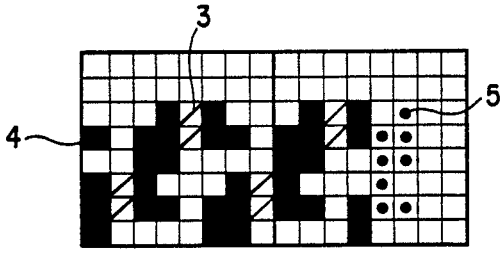
FIG. 2 is a schematic view illustrating pattern design of the weave of a fabric incorporating electrically conductive combination threads according to the invention.
Figure 3:
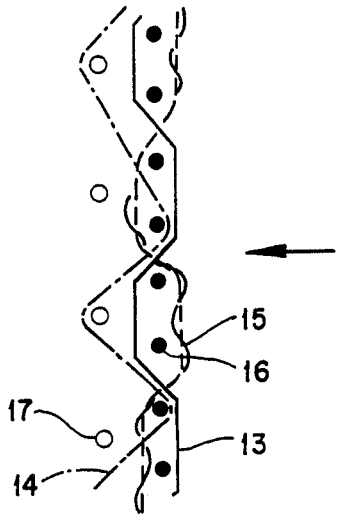
FIG. 3 is a schematic cross-section of a fabric according to the invention in which the arrow points to the fabric face which is the upper ply.
Figure 4:
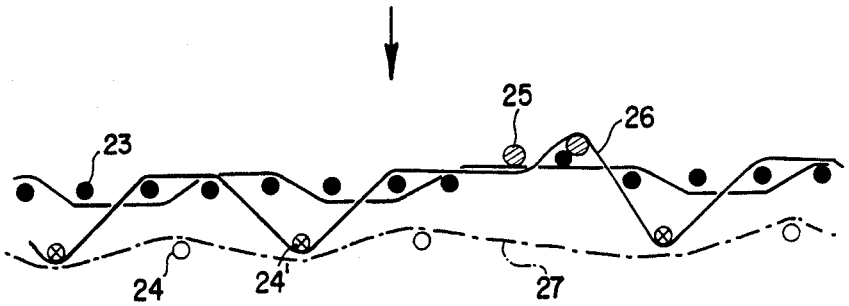
FIG. 4 is a schematic cross-section of a fabric according to the invention in which the arrow points to the fabric face which is the upper ply.

Thus, in FIG. 1, the upper ply warp yarns are interwoven with the upper ply filling yarns in a 2/2 twill weave (represented by the solid block squares 1) and the lower ply filling yarns 1 are the filling yarns of a 1/1 plain weave. In FIG. 2, the upper ply warp yarns 4 intersect (interweave with) the lower ply filling yarns at 3 (the intersections being represented by slanted strokes) and the electrically conductive combination warp yarns are interwoven with the upper ply filling yarns at intersections 5 (represented by black dots). In FIG. 3, the upper ply warp yarns 13 are interwoven with the upper ply filling yarns 16, the electrically conductive combination wrap yarns 15 are also interwoven with the upper ply filling yarns 16, and the lower ply warp yarns 14 are interwoven with the lower ply filling yarns 17 as well as with the upper ply filling yarns 16. In FIG. 4, the upper ply warp yarns 23 are interwoven with the upper ply filling yarns 26, the electrically conductive combination warp yarns 25 are interwoven with the upper ply filling yarns 26, the lower ply warp yarns 24 are interwoven only with the lower ply filling yarns 27 and the lower ply filling yarns 27' are interwoven with both the upper ply filling yarns 26 and the lower ply filling yarns 27.

As a result of this fabric construction, the electrically conductive combination threads can be stressed at least 25% more.

In addition to the effect described, the particle permeability is reduced substantially by means of this inventive fabric contruction. Moreover, since it is the lower ply which comes into contact with the skin, a substantially better wear comfort effect is additionally achieved.

All the effects described are washfast.

The invention will be better understood from the following examples:

EXAMPLE 1:

(A) Electrically conductive combination twisted yarn of nominal size 25 tex

This yarn consists of 2 components:

(1) a 0.036 mm diameter chromium/nickel/molybdenum metal wire of nominal size 8 tex, (2) a white polyester 80 filament yarn stretch-textured by the jet process and having a nominal size of 16.7 tex.

The combined yarn is produced as follows:

known doubling-winding process with the process specially controlled as follows

* tension on metal wire - 80%
* tension on the textured polyester yarn - 100%
* tension force level approx. 8% of the size-related breaking strength of the polyester yarn.

Use of special grooved drums to make certain that the twisted thread is wound up accurately;

known two-for-one twisting process as winding-doubling feed

* using twisting flyers
* without balloon limiting device
* spindle speed: 9000 r.p.m.
* yarn twisting: 350 r.p.m.
* brake cartridge: 0
* step brake: 1
* thread guide height: 41
* overfeed: 32%

(B) Technical Specifications for the Example 1 fabric for clean-room use:

Raw material

* conductive combination twisted yarn of a nominal size 25 tex (as described in A.)
* nonconductive synthetic yarn consisting of polyester 64 filament yarn of nominal size 17 tex together with polyester 32 filament yarn of nominal size 15 tex total number of yarns: 7590 warp sequence: 20 yarns of nonconductive synthetic filament (polyester) and 2 yarns of conductive combination double yarn order of drawing in: straight through number of frames: 6 reed density: 150/3 (150 reeds, each 10 cm, 3 yarns per reed)

reed width: 168.7 cm unfinished width: 165 cm finished width: 152 cm+2 cm filling sequence: 26 of the nonconductive 15 tex, 32 filament polyester yarn and 2 of the conductive combination twisted yarns filling density, raw: 330 threads/10 cm filling density, finished: 330 threads/10 cm area related weight, finished: 160 g/m$^2$ weave: 2/1 "Z" direction twill weave finishing

* washing: known washing process in jigger with addition of oxalic acid
* drying and setting: tentering, drying and setting machine at a temperature of 210° C., residence time of 20–30 seconds
* dyeing: known dyeing process on high-temperature beam at 130° C.
* drying: tentering, drying and setting machine at a temperature of 160° C.
* equalizing on roll.

EXAMPLE 2

Electrically conductive combination twisted yarn of nominal size 25 tex

This yarn consists of the same two components as in Example 1.

The combined yarn is produced as follows:

A twisting process is conducted according to the hollow spindle principle. The polyester yarn, textured by the jet process, has a low elasticity. During the twisting, tension is applied to this core component by means of known, infinitely variable thread brakes up to a maximum corresponding to 12% of the breaking strength of the yarn. The sheating metal wire is wrapped in a continuous helical line around this core component. This metal wire is wound in approximately parallel fashion on a rotating creel spool and is wrapped uniformly at the rate of 350 turns/minute around this core component by a downtwister operating at a spindle speed of 10,500 r.p.m.

The combination twisted yarn, so obtained, is woven and finished by known methods.

EXAMPLE 3:

1. The electrically conductive combination twisted yarn is the same as in Examples 1 and 2.

2. The electrically nonconductive synthetic yarn is the same as in part B of Example 1.

3. The fabric below is constructed using the electrically conductive combination yarn 1 and the electrically nonconductive yarn 2.

total number of yarns: 8,000 warp sequence: 12 ends of nonconductive yarn and 2 ends of conductive combination yarn order of drawing in: broken number of frames: 12 reed density: 120/4 (120 reeds, each 10 cm, 4 threads per reed)

reed width: 164 cm raw width: 157.5 cm finished width: 152 cm±2 cm filling sequence: even filling density, raw: 500 filling density, finished: 510 weave: This is according to the weave configuration shown in FIGS. 1 to 3.

FIG. 1 shows the weave of the upper ply, including the electrically conductive combination yarns FIG. 2 shows the weave of the lower ply FIG. 3 shows the point paper design of the weave Description of the Weave:

| | |
|---|---|
| Drawn "solid" black squares in the Figures | The electrically nonconductive upper ply warp yarns of nominal size 17 tex, 64 filament polyester together with the electrically nonconductive upper ply filling yarns of nominal size 15 tex, 32 filament polyester are woven into a 2/2 "Z" direction twill weave. |
| Drawn as black "slashes" in the Figures | The electrically conductive lower ply warp yarns of nominal size 17 tex, 64 filament polyester twisted with the metal wire together with the electrically nonconductive lower ply filling yarns of polyester filaments of nominal size 15 tex, 32 filament polyester yarn are woven into a 1/1 plain weave. Within a pattern repeat, 4 electrically nonconductive lower ply warp yarns are interwoven with 4 electrically nonconductive upper ply filling yarns in plain weave fashion. |
| Drawn as black points in the Figures | Two electrically conductive combination yarns of of nominal size 25 tex as described in part "1." of this example, as warp yarns within a pattern repeat, together with all electrically conductive upper |

-continued

| | |
|---|---|
| | ply filling threads in the pattern repeat consisting of nominal size 15 tex, 32 filament polyester yarns woven into a 2/2 "Z" direction twill weave opposite to the 2/2 "Z" direction twill weave upper ply warp yarns. |

4. Finishing

* Washing: Known washing process in jigger with addition of oxalic acid

* Drying and setting: Tentering, drying and setting machine at a temperature of 210° C. and a residence time of 20–30 seconds

* Dyeing: known dyeing process on high-temperature beam at 130° C.

* Drying: tentering, drying and setting machine at a temperature of 160° C.

* Equalizing on roll

What we claim is:

1. Fabric for the production of textile flat goods and wearing apparel for clean rooms comprising electrically conductive combination yarns and electrically nonconductive synthetic yarns, the fabric having an upper ply of electrically nonconductive combination yarns and a lower ply stabilizing the upper ply and interwoven with the electrically nonconductive yarns of the upper ply, wherein the lower ply includes electrically nonconductive lower ply warp yarns interwoven with electrically nonconductive lower ply filling yarns into a 1/1 plain weave, 4 electrically nonconductive lower ply warp yarns within a pattern repeat additionally interwoven with 4 electrically nonconductive filling yarns in the upper ply in a plain weave, and 2 electrically conductive combination warp yarns within a pattern repeat interwoven with all electrically nonconductive filling yarns in the upper ply in a pattern repeat in a 2/2 twill weave opposite 2/2 twill woven upper ply warp yarns.

2. A fabric as defined in claim 1, wherein the electrically conductive combination yarns comprise a metal wire and a synthetic filament component.

* * * * *